US006991590B2

(12) United States Patent
Vigiano

(10) Patent No.: US 6,991,590 B2
(45) Date of Patent: Jan. 31, 2006

(54) ERGONOMIC HANDGRIP FOR WEIGHT LIFTING PLATES

(76) Inventor: James Vigiano, P.O. Box 430, 1211 Weaver Rd., Herrin, IL (US) 62948

( * ) Notice: Subject to any disclaimer, the term of this patent is extended or adjusted under 35 U.S.C. 154(b) by 0 days.

(21) Appl. No.: 10/771,351

(22) Filed: Feb. 5, 2004

(65) Prior Publication Data

US 2004/0166997 A1 Aug. 26, 2004

Related U.S. Application Data

(60) Provisional application No. 60/448,905, filed on Feb. 24, 2003.

(51) Int. Cl.
*A63B 21/00* (2006.01)

(52) U.S. Cl. ..... 482/106; 482/108

(58) Field of Classification Search ..... 482/106–108; D21/681

See application file for complete search history.

(56) References Cited

U.S. PATENT DOCUMENTS 4,730,827 A * 3/1988 Williams ..... 482/47
5,137,502 A 8/1992 Anastasi
D424,140 S 5/2000 Lincir
6,319,176 B1 11/2001 Landfair
D454,167 S 3/2002 Lincir
6,436,015 B1 8/2002 Frasco et al.
D463,001 S 9/2002 Buchanan
D474,517 S * 5/2003 Harms ..... D21/681
6,702,723 B2 * 3/2004 Landfair ..... 482/93
2001/0049324 A1 12/2001 Wallace et al.
2002/0091044 A1 7/2002 Lien et al.

* cited by examiner

*Primary Examiner*—Jerome W. Donnelly
(74) *Attorney, Agent, or Firm*—Richard C. Litman

(57) ABSTRACT

A weight plate for fitness weightlifting that provides an ergonomic gripping device is described. The ergonomic weight plate comprises a disc-shaped member having a center through-hole for positioning the weight plate onto a barbell. The disc-shaped member further comprises at least one ergonomic gripping cutout located around the periphery of the disc-shaped member. The gripping cutouts are adapted to receive human fingers to facilitate lifting of the weight plate. The ergonomic gripping cutouts each have an outer periphery and an inner periphery. A portion of the outer periphery of the cutouts is convex to properly conform the gripping cutout to the shape of a human hand. In a second embodiment the gripping cutout has a grip enhancement strip located on the inner surface of the outer periphery of the gripping cutouts.

16 Claims, 3 Drawing Sheets

ERGONOMIC HANDGRIP FOR WEIGHT LIFTING PLATES

CROSS-REFERENCE TO RELATED APPLICATION

This application claims the benefit of U.S. Provisional Patent Application Ser. No. 60/448,905, filed Feb. 24, 2003.

BACKGROUND OF THE INVENTION

1. Field of the Invention

The present invention relates to weightlifting equipment, and more particularly to weightlifting plates with ergonomic handgrips.

2. Description of Related Art

Weightlifting has become an extremely common form of physical exercise. Weightlifters have many options when choosing which equipment to perform their exercises. Most fitness centers provide stationary weightlifting machines, as well as free weights. Free weights are usually in the form of dumbbell or barbell weights. Conventional barbell weights are disc shaped and are equipped with a center through-hole for placing the barbell weight onto a barbell. Conventional barbell weights are often difficult to lift and position onto a barbell. It is also difficult to use the barbells weights in place of dumbbells in many typical weightlifting exercises. These difficulties arise because there is usually no convenient or comfortable manner in which to grip the barbell weights.

The following patent documents disclose barbell weights that provide a structure for gripping the weights. U.S. Design Pat. No. 463,001 to Buchanan discloses an ornamental design of a weight plate with three holes located around the periphery of the plate. U.S. Design Pat. No. 454,167 to Lincir discloses an ornamental design of a weight plate with six holes around the periphery. U.S. Design Pat. No. 424, 140 to Lincir discloses an ornamental design of a weight plate with five circular holes around the periphery of the weight plate.

U.S. Pat. No. 6,319,176 to Landfair discloses a weightlifting plate having rotatable handles. The plate includes notches lying at two opposite sides of the plate. Flanges lie at each corner of the mouths of the notches. The flanges are designed to receive the handle assemblies.

U.S. Pat. Publication. No. 2002/0091044 discloses an improved weight plate. The weight plate includes a plurality of flange members. The flange members are spaced from each other, defining gaps therebetween. The gaps are dimensioned so that one or more fingers of a human hand can be extended through the gaps for engaging the bottom flat surface of the weight plate. The weight plate further includes one opening that can accommodate one or more fingers for gripping.

U.S. Pat. Publication. No. 2001/0049324 discloses a weight plate that incorporates a plurality of handgrips formed near the peripheral surface of the weight plate. The handgrips have a transverse width and radial height that provide a convenient grip for individuals with smaller hands. The location of the handgrips facilitates lifting and transporting of the weight plates by reducing the stresses on the weightlifter's shoulder joints.

U.S. Pat. No. 6,436,015 to Frasco et al. discloses a weight plate having solely a triad of integrally formed handles. The weight plate comprises a plate body with a center through-hole for positioning the weight plate onto an exercise barbell. The plate body further comprises solely a triad of spaced apart elliptical handle openings disposed equiangularly and positioned radially outwardly from the center through-hole. The triad of openings acts as handles for lifting and transporting the weight plate.

U.S. Pat. No. 5,137,502 to Anastasi discloses a weight plate for physical fitness having an integrally made handle. The disc-shaped weight plate includes a circular opening in the center of the plate for positioning the plate onto a barbell. The weight plate further includes a pair of diametrically opposed, elongated oval openings disposed parallel to one another and equidistant from the circular opening. The oval openings are positioned so that the fingers and thumb of a human hand may be disposed through the openings for gripping of the weight to facilitate lifting and transport of the weight.

None of the existing weightlifting plates, however, are equipped with a gripping slot that conforms to the fingers of the weightlifter. The gripping slots in the existing weight plates are typically elliptical or circular. The periphery of the gripping slots does not conform to the natural position of the hand. When a human hand grips a weight plate with the existing slots, the weight of the plate is not distributed evenly across the four fingers, and this makes it difficult to carry the weight plate. The existing weight plates apply unnecessary pressure to the weight lifter's index and pinky fingers.

Therefore, what is needed is a weight plate with a grip cutout that provides ergonomic support to the user's hands. What is further needed is a weight plate with a grip cutout that molds to the inside of a human hand and evenly distributes the weight across the four fingers, making it easier to carry the weight plate. What is still further needed is a weight plate with a grip enhancement device that is located on the grip cutout to improve the degree of comfort when carrying the weight plate.

None of the above inventions and patents, taken either singly or in combination, is seen to describe the instant invention as claimed.

SUMMARY OF THE INVENTION

The present invention is an improved weight plate for fitness weightlifting that provides an ergonomic gripping device. The ergonomic weight plate comprises a disc shaped member having a center through-hole for positioning the weight plate onto a barbell. The diameter of the through-hole is slightly larger than that of a conventional barbell to allow the weight plate to be easily positioned onto and slide along the barbell. The disc shaped member further comprises ergonomic gripping cutouts located around the periphery of the disc shaped member. The gripping cutouts are adapted to receive human fingers to facilitate lifting of the weight plate.

Each of the ergonomic gripping cutouts is made up of an outer periphery and an inner periphery. The outer periphery is defined as the side of the cutout located in proximity to the outer edge of the weight plate and the inner periphery is defined as the side of the cutout located in proximity to the center through-hole. The outer periphery of the cutouts is defined by a convex curvature of the weight plate to properly conform the gripping cutout to the shape of a human hand. The convex outer periphery results in the outer periphery of the cutout protruding inward towards the center of the disc defining the weight plate. This new convex outer periphery of the gripping cutouts is an improvement over the elliptical and circular gripping slots of past weight plates. The elliptical and circular gripping slots of previous weight plates did not conform to the natural shape of the weightlifter's hands. The previous gripping slots placed unnecessary pressure on the index and pinky fingers of the weightlifters. The convex curve of the outer periphery evenly distributes the weight of the plate across each of the fingers placed inside of the gripping cutout.

In a second embodiment the gripping cutout further comprises a grip enhancement strip. The grip enhancement strip is located on the inner surface of the outer periphery of the gripping cutouts. The grip enhancement strip comprises a plurality of finger receiving notches that are each adapted to receive a finger from the user's hand. The finger receiving notches improve the grip on the weight plate and also improve the comfort when lifting and transporting the weight plate.

Accordingly, it is a principal object of the invention to provide a weight plate with a grip cutout that provides ergonomic support to the weightlifters hands while lifting and transporting the weight plate.

It is another object of the invention to provide a weight plate with a grip cutout that molds to the inside of a human hand and evenly distributes the weight across the four fingers making it easier to carry the weight plate.

It is a further object of the invention to provide a grip enhancement device that is located on the grip cutout to improve the degree of comfort when carrying the weight plate.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
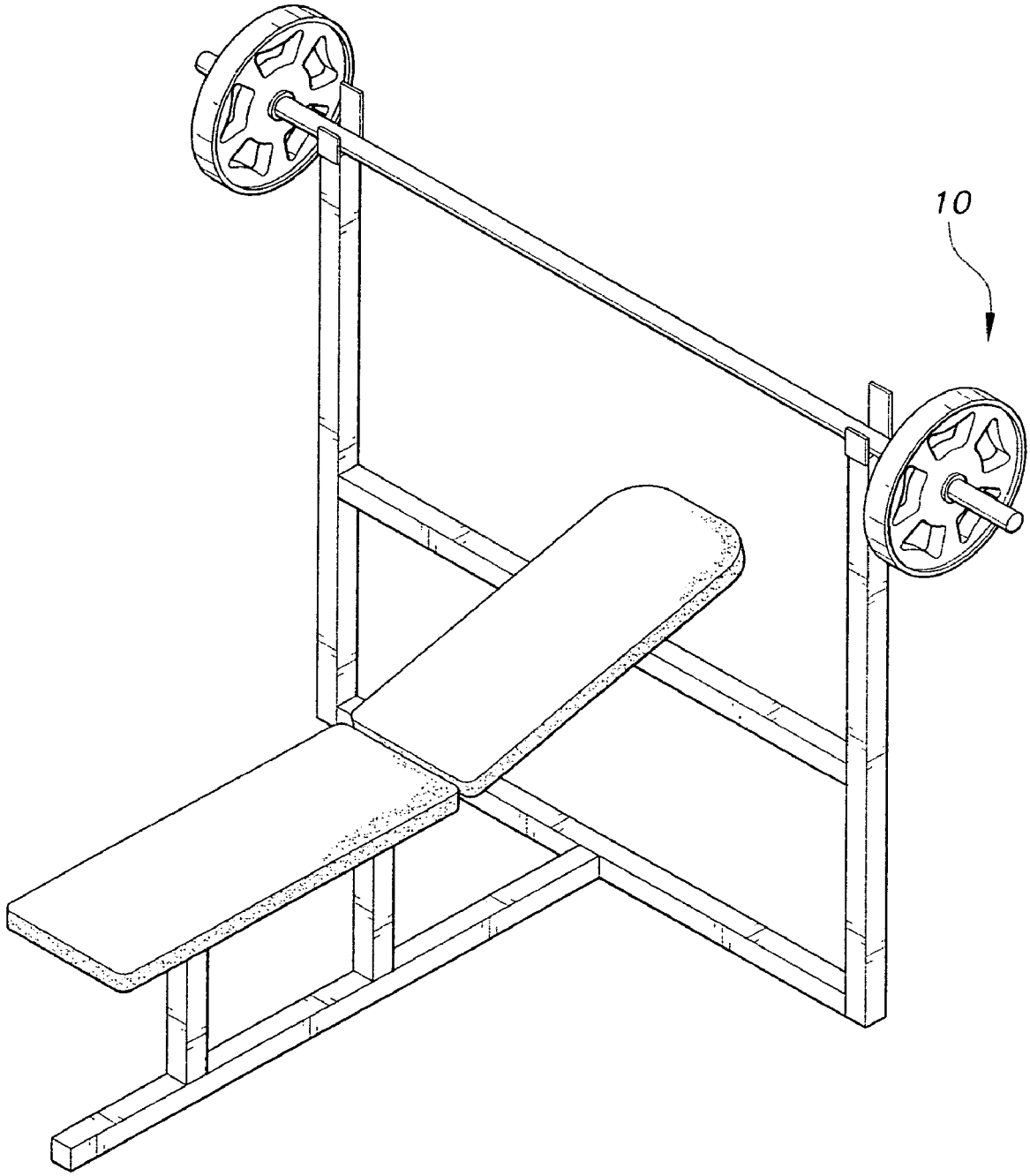
FIG. 1 is an environmental, perspective view of an ergonomic handgrip for weightlifting plates according to the present invention.

The present invention is an improved fitness weight plate that provides the user with an ergonomically benefiting gripping mechanism for comfortably lifting and transporting the weight plate. FIG. 1 depicts an ergonomic weight plate 10 being used with a conventional weightlifting bench and barbell assembly. Weightlifting plates are typically constructed in varying sizes so that a weightlifter may add varying combinations of weight plates to a barbell to achieve a desired degree of resistance on the barbell. Typically, weight plates are made in 2.5, 5, 10, 25, 35, 45 and 100 pound plates.

Figure 2:
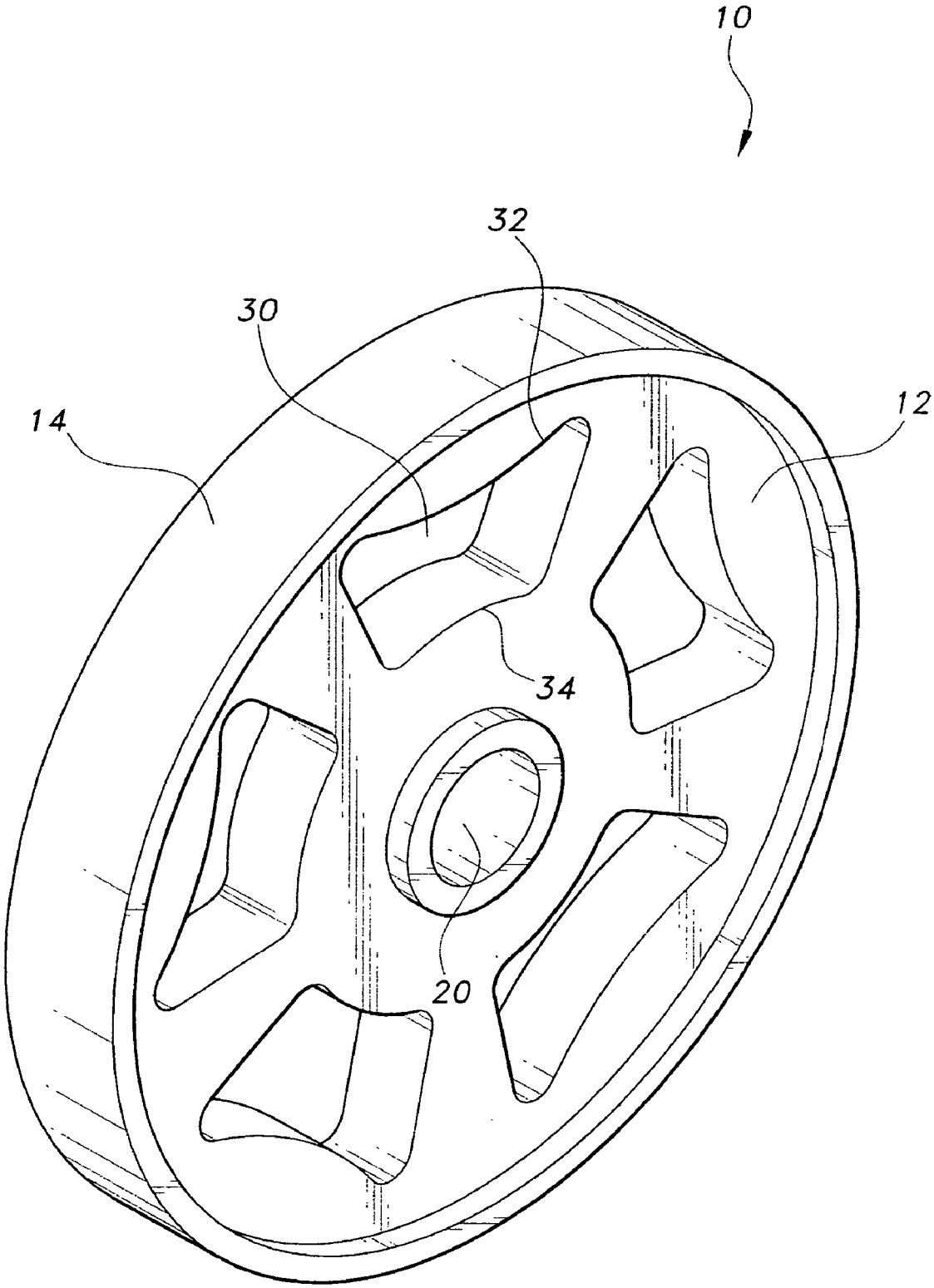
FIG. 2 is a perspective view of a first embodiment of a weight plate equipped with the ergonomic handgrips of the present invention.

FIG. 2 depicts a single ergonomic weight plate 10 according to the present invention. The weight plate 10 comprises a disc shaped member 12 with a rounded outer edge 14. The dimensions of the disc member 12 will vary depending on the specified weight of the particular weight plate 10. The weight plate 10 is preferably made from cast iron with a urethane coating. The urethane coating minimizes damage to the floor of the fitness area if the weight plates are dropped. The weight plate 10 however, is not limited to being made from cast iron with a urethane coating and may be from any suitable materials including, but not limited to, cast iron with a rubber coating, cast iron with a powder paint coating, and hard plastic filled with sand.

The ergonomic weight plate 10 further comprises a mounting hole 20 located in the center of the disc shaped member 12. The mounting hole 20 is a through-hole that is adapted to receive a fitness barbell. The mounting hole 20 allows a weightlifter to position the weight plate 10 onto a barbell. The diameter of the mounting hole 20 is slightly larger than that of a conventional barbell so that the weight plate may be positioned on and slid along the barbell.

The ergonomic weight plate 10 additionally comprises at least one gripping cutout 30. The gripping cutout 30 is a through-hole in the disc member 12 that is adapted to receive the fingers of a human hand. In use, a weightlifter places his fingers into the gripping cutout 30 and grips the weight plate 10 to facilitate lifting and transporting of the weight plate 10. The preferred embodiment of the weight plate 10 depicted in FIG. 2 has five gripping cutouts 30 positioned around the outer periphery of the disc member 12. The gripping cutouts 30 may be arranged around the outer periphery of the disc member 12 in any particular manner. The gripping cutouts 30 may evenly spaced or spaced at varying intervals. Alternate embodiments of the ergonomic weight plate include one, two or four gripping cutouts.

Each gripping cutout 30 comprises an outer periphery 32 and an inner periphery 34. The outer periphery is located in proximity to the outer edge 14 of the disc member 12, while the inner periphery 34 is located in proximity to the mounting hole 20. Each gripping cutout 30 is large enough to receive the four fingers of a weightlifter's hands. The gripping cutouts 30 are positioned close enough to the outer edge 14 of the disc member 12 so that the typical weightlifter may position the fingers inside of the gripping cutouts 30 while wrapping the remainder of the hand around the outer edge 14.

The outer periphery 32 of the cutouts 30 is shaped to conform to the weightlifter's hands. As shown in FIG. 2, the outer periphery 32 (i.e., the portion of the disc body defining the cutout 30) is convex in shape. The outer periphery 32 protrudes towards the center of the disc member 12. The convex shape of the outer periphery 32 evenly distributes the mass of the weight plate 10 to each of the fingers placed in the cutout 34. This reduces the stress on the weightlifter's hands and wrists when gripping the weight plate 10 and it facilitates easier lifting of the weight plate 10.

Figure 3:
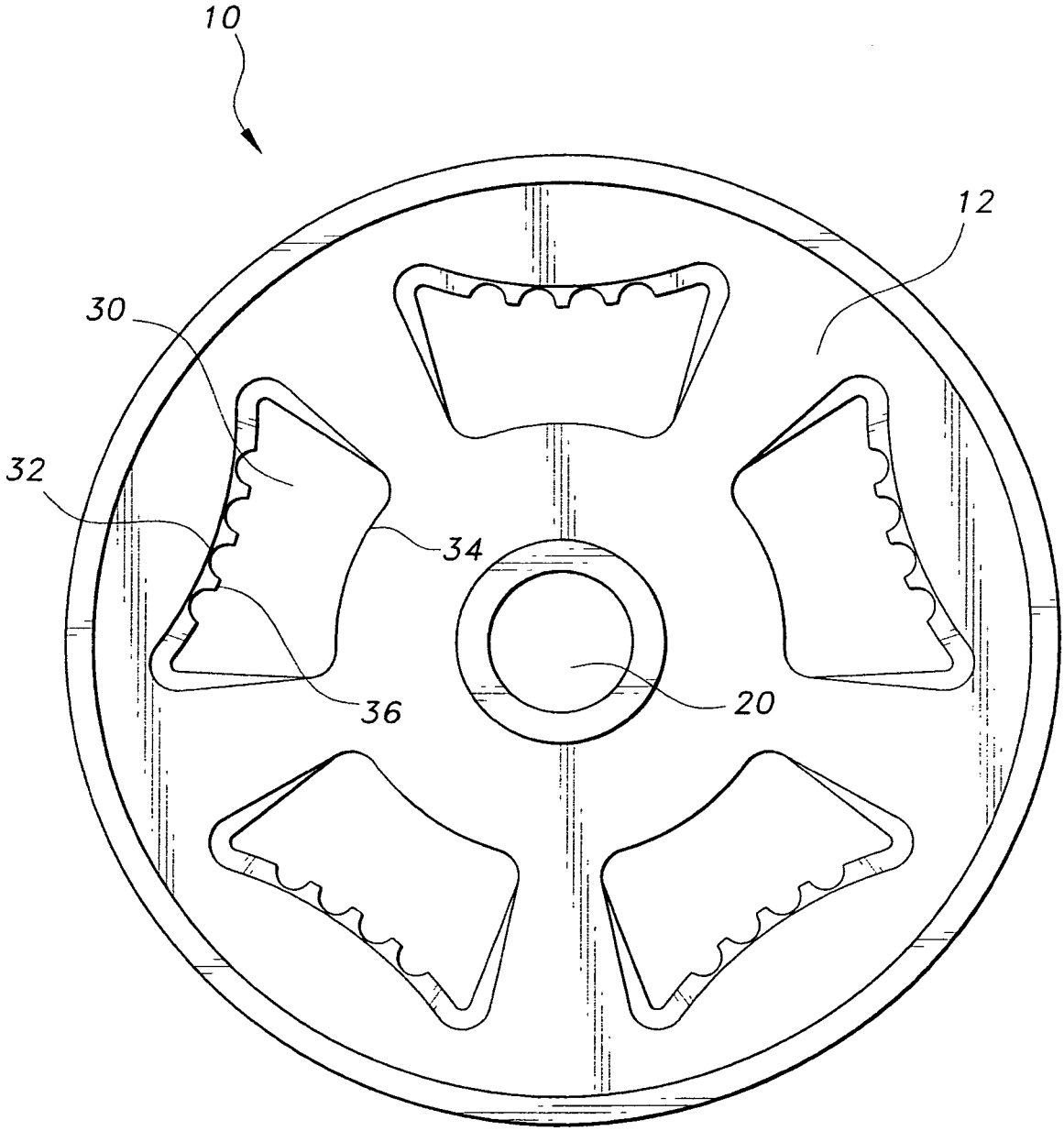
FIG. 3 is a front view of a second embodiment of the ergonomic handgrip for weightlifting plates.

FIG. 3 depicts the front view of a second embodiment of the ergonomic weight plate 10. The weight plate 10 in the second embodiment comprises most of the same components as discussed in the first embodiment. In addition to the components discussed above, the present embodiment further comprises a grip enhancement strip 36. The grip enhancement strip 36 is disposed on the inner surface of the outer periphery 32. The grip enhancement strip 36 provides a tighter and more comfortable grip for the weightlifter. The grip enhancement strip 36 further comprises a plurality of finger receiving slots as depicted in FIG. 3. Each of the finger receiving slots is adapted to fit a single finger and ensures equal distribution of weight across the four fingers.

In additional embodiments of the weight plate 10 the gripping cutouts 30 may also be sloped inward from the disc member 12 allowing more space for the user's fingers. This feature aids the weightlifter when attempting to pick up the weight plate 10 while it is lying. flat on the floor. Additionally, handgrip grooves similar to the grip enhancement strip 36 may be positioned along the outer edge 14 to aid in separating of the weight plates while they are mounted on a conventional barbell.

It is to be understood that the present invention is not limited to the embodiments described above, but encompasses any and all embodiments within the scope of the following claims.

I claim:

1. An ergonomic weight plate, comprising:

a unitary disc-shaped member having a rounded periphery and a center through-hole for positioning the disc-shaped member onto a barbell; and at least one handle, each said at least one handle being integrally formed in said disc-shaped member, each said at least one handle having an ergonomic gripping surface defining a wall of a cutout in said disc-shaped member, each said ergonomic gripping surface having a convex curvature defined in said disc-shaped member so that convex curvature protrudes inward towards the center through-hole;

whereby each said ergonomic gripping surface is adapted to receive fingers of a hand of a weightlifter in order to facilitate lifting of said disc-shaped member;

wherein the convex curvature of said ergonomic gripping surface conforms to the fingers of the weightlifter.

2. The weight plate according to claim 1, wherein said disc-shaped member has a known, defined weight, whereby the weightlifter is able to add a known weight increment onto the barbell.

3. The weight plate according to claim 2, wherein said disc-shaped member has a weight in a range between about 2.5 and 100 pounds.

4. The weight plate according to claim 1, wherein each said ergonomic gripping surface is positioned proximate to the rounded periphery;

whereby the fingers of the weightlifter are positioned adjacent said ergonomic gripping surface as the hand grasps the rounded periphery of said disc-shaped member.

5. The weight plate according to claim 1, further comprising a grip enhancement strip attached to each said ergonomic gripping surface of each said at least one handle.

6. The weight plate according to claim 5, wherein said grip enhancement strip further comprises a plurality of finger receiving slots, each of said finger receiving slots being adapted to fit a single finger for improved gripping of said weight plate.

7. The weight plate according to claim 1, wherein said disc-shaped member is made from materials selected from the group consisting of cast iron having a urethane coating, cast iron having a rubber coating, cast iron having a powder paint coating and hard plastic filled with sand.

8. An ergonomic weight plate, comprising:

a unitary disc-shaped member having a rounded periphery and a center through-hole for positioning the disc-shaped member onto a barbell;

at least one handle, each said at least one handle being integrally formed in said disc-shaped member, each said at least one handle having an ergonomic gripping surface defining a wall of a cutout in said disc-shaped member, each said ergonomic gripping surface having a convex curvature defined in said disc-shaped member so that convex curvature protrudes inward towards the center through-hole; and a grip enhancement strip disposed on each said ergonomic gripping surface, each said grip enhancement strip having a plurality of finger receiving slots;

whereby each said ergonomic gripping surface is adapted to receive fingers of a hand of a weightlifter in order to facilitate lifting of said disc-shaped member;

wherein the convex curvature of said ergonomic gripping surface conforms to the fingers of the weightlifter.

9. The weight plate according to claim 8, wherein said disc-shaped member has a known, defined weight, whereby the weightlifter is able to add a known weight increment onto the barbell.

10. The weight plate according to claim 9, wherein said disc-shaped member has a weight in a range between about 2.5 and 100 pounds.

11. The weight plate according to claim 8, wherein each said ergonomic gripping surface is positioned proximate to the rounded periphery;

whereby the fingers of the weightlifter are positioned adjacent said ergonomic gripping surface as the hand grasps the rounded periphery of said disc-shaped member.

12. The weight plate according to claim 8, wherein said disc-shaped member is made from materials selected from the group consisting of cast iron having a urethane coating, cast iron having a rubber coating, cast iron having a powder paint coating and hard plastic filled with sand.

13. The weight plate according to claim 1, said at least one handle further includes a plurality of handles, wherein each handle has said convex curvature of said ergonomic gripping surface.

14. The weight plate according to claim 13, wherein said plurality of handles is at least four handles.

15. The weight plate according to claim 8, said at least one handle further includes a plurality of handles, wherein each handle has said convex curature of said ergonomic gripping surface.

16. The weight plate according to claim 15, wherein said plurality of handles is at least four handles.

* * * * *